US010625895B2

(12) United States Patent
Bacallao et al.

(10) Patent No.: US 10,625,895 B2
(45) Date of Patent: Apr. 21, 2020

(54) BAG RETAINING FIXTURE

(71) Applicant: Walmart Apollo, LLC, Bentonville, AR (US)

(72) Inventors: Yurgis Mauro Bacallao, Centerton, AR (US); Ruth Victoria Dengler, Baltic, SD (US); Cynthia Marie Scholtes Kennedy, Pea Ridge, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 14 days.

(21) Appl. No.: 16/143,800

(22) Filed: Sep. 27, 2018

(65) Prior Publication Data

US 2019/0127103 A1 May 2, 2019

Related U.S. Application Data

(60) Provisional application No. 62/577,433, filed on Oct. 26, 2017.

(51) Int. Cl.
*B65B 67/12* (2006.01)
*A47F 9/04* (2006.01)

(52) U.S. Cl.
CPC ..... *B65B 67/1233* (2013.01); *B65B 67/1266* (2013.01); *A47F 9/042* (2013.01); *B65B 2067/1294* (2013.01)

(58) Field of Classification Search
CPC ..... B65B 67/1266; B65B 67/1211; B65B 67/1233; B65B 2067/1294; A47F 9/042
USPC ..... 248/465.1, 107, 112, 153, 175, 218.1, 248/249, 302; 211/41.4, 85.31, 90.3, 106, 211/112, 119, 126.8, 126.9, 133.2, 133.5, 211/181.1
See application file for complete search history.

(56) References Cited

U.S. PATENT DOCUMENTS

| | | | |
|---|---|---|---|
| 94,016 | A | 8/1869 | Mayo et al. |
| 228,627 | A | 6/1880 | Gordon |
| 473,099 | A | 4/1892 | Vincentz |
| 636,491 | A | 11/1899 | Cohen |

(Continued)

FOREIGN PATENT DOCUMENTS

| | | |
|---|---|---|
| JP | 6096712 B2 | 3/2017 |
| WO | 2006130911 A1 | 12/2006 |

OTHER PUBLICATIONS

Weimaamerica, "Carousel Bagging System for WEIMA Briquette Press," YouTube.com, Apr. 15, 2009.

(Continued)

*Primary Examiner* — Muhammad Ijaz
(74) *Attorney, Agent, or Firm* — Schmeiser, Olsen & Watts LLP; Karen E. Jachimowicz

(57) ABSTRACT

Described is a bagging station for use in a retail store to hold paper bags for filling with purchased products. The bagging station includes a bag retaining fixture for holding paper bags instead of hooks for holding plastic bags. The bag retaining fixture includes an elongate rod and a roller wheel. The elongate rod acts as an axle for the roller wheel. The elongate rod is coupled to a side wall of the bagging station. The elongate rod biases the roller wheel against the side wall. A side of a bag placed between the roller wheel and the side wall holds the paper bag in position on the bagging station so the bag can be filled with purchased items, then removed to be carried out of the store.

20 Claims, 7 Drawing Sheets

(56) References Cited

U.S. PATENT DOCUMENTS

| | | | | |
|---|---|---|---|---|
| 721,996 | A | 12/1902 | Bunnell | |
| 743,547 | A | 7/1903 | Nix | |
| 1,355,643 | A * | 10/1920 | Bausano | A47C 7/64 211/89.01 |
| 1,754,327 | A | 4/1930 | Leonard | |
| 1,845,385 | A | 2/1932 | Zelenka | |
| 2,107,997 | A | 2/1938 | Horsley | |
| 2,324,596 | A | 7/1943 | Quain | |
| 2,521,604 | A * | 9/1950 | Provost | A47K 10/12 248/316.3 |
| 2,616,133 | A | 11/1952 | Peters | |
| 2,722,469 | A | 11/1955 | Kosovsky | |
| 2,766,822 | A | 10/1956 | Potter | |
| 3,055,508 | A | 9/1962 | Reeser | |
| 3,175,793 | A | 3/1965 | Kennedy | |
| 3,262,579 | A * | 7/1966 | Reich | A47K 10/12 211/45 |
| 3,294,465 | A | 12/1966 | Blodee et al. | |
| 3,424,421 | A | 1/1969 | Kalbow | |
| 3,434,686 | A * | 3/1969 | Yoshizaburo | B42F 15/066 248/316.3 |
| 3,628,632 | A | 12/1971 | Lambert | |
| 3,679,096 | A | 7/1972 | Musser | |
| 3,747,298 | A | 7/1973 | Lieberman | |
| 3,838,839 | A | 10/1974 | Spencer | |
| 3,847,332 | A | 11/1974 | Spencer | |
| 4,062,170 | A | 12/1977 | Orem | |
| 4,085,822 | A | 4/1978 | Osborn | |
| 4,094,415 | A | 6/1978 | Larson | |
| 4,106,733 | A | 8/1978 | Walitalo | |
| 4,106,734 | A | 8/1978 | Walitalo | |
| 4,143,845 | A | 3/1979 | Harris | |
| 4,155,458 | A | 5/1979 | Moline | |
| 4,171,150 | A | 10/1979 | Soderlund | |
| 4,217,012 | A | 8/1980 | Klaus | |
| 4,289,242 | A | 9/1981 | Kenyon | |
| 4,398,689 | A | 8/1983 | Prader | |
| 4,498,652 | A | 2/1985 | Malik | |
| 4,600,254 | A | 7/1986 | Whalen | |
| 4,657,318 | A | 4/1987 | Strange | |
| 4,696,522 | A | 9/1987 | Lowe | |
| 4,771,966 | A * | 9/1988 | Anderson | A47K 10/40 225/51 |
| 4,785,971 | A | 11/1988 | Konarik | |
| 4,793,665 | A | 12/1988 | King | |
| 4,826,022 | A | 5/1989 | Duarte | |
| RE33,122 | E | 12/1989 | Orem | |
| 5,012,994 | A | 5/1991 | Keefe | |
| 5,054,728 | A | 10/1991 | Nigro | |
| 5,131,499 | A | 7/1992 | Hoar | |
| 5,184,728 | A | 2/1993 | Wile | |
| 5,255,970 | A | 10/1993 | Theosabrata | |
| 5,269,416 | A | 12/1993 | DeMatteis | |
| 5,295,743 | A | 3/1994 | Moulton et al. | |
| 5,399,010 | A | 3/1995 | McClung et al. | |
| 5,407,170 | A | 4/1995 | Slivon et al. | |
| 5,462,178 | A | 10/1995 | Wallach et al. | |
| 5,467,572 | A | 11/1995 | Wile et al. | |
| 5,524,979 | A | 6/1996 | Carson et al. | |
| 5,632,409 | A | 5/1997 | Raghunanan | |
| 5,803,563 | A | 9/1998 | Woodward | |
| 5,885,002 | A | 3/1999 | Reiss | |
| 5,964,060 | A | 10/1999 | Furlong | |
| 6,474,478 | B1 | 11/2002 | Huehner et al. | |
| 6,491,218 | B2 | 12/2002 | Nguyen | |
| 6,550,583 | B1 | 4/2003 | Brenhouse | |
| 6,622,979 | B2 | 9/2003 | Valiulis | |
| 7,114,650 | B2 * | 10/2006 | Sherrod | G07F 11/24 235/381 |
| 7,172,092 | B2 | 2/2007 | Yang et al. | |
| 7,516,820 | B1 | 4/2009 | Cox | |
| 7,753,588 | B2 | 7/2010 | Bazbaz | |
| 7,784,625 | B2 | 8/2010 | Burgess et al. | |
| 7,866,546 | B1 | 1/2011 | Vance | |
| 7,882,964 | B2 | 2/2011 | Battaglia | |
| D665,193 | S | 8/2012 | Huffey | |
| 8,256,644 | B2 | 9/2012 | Orgna | |
| 8,359,722 | B2 | 1/2013 | Polizzi | |
| 8,400,324 | B1 | 3/2013 | Jaeger | |
| 8,584,982 | B2 * | 11/2013 | Eakin | A47K 10/38 242/422.5 |
| 8,678,281 | B2 | 3/2014 | Kangas et al. | |
| 8,707,626 | B2 | 4/2014 | Martin | |
| 9,101,232 | B1 | 8/2015 | Newman | |
| 9,622,598 | B1 | 4/2017 | Davis, Jr. | |
| 9,622,599 | B2 | 4/2017 | Davis, Jr. | |
| 9,750,356 | B2 | 9/2017 | Tan | |
| 9,770,123 | B2 | 9/2017 | Tan | |
| 10,028,598 | B2 | 7/2018 | Bacallao et al. | |
| 10,029,815 | B2 * | 7/2018 | Robinson | B65B 67/1227 |
| 10,106,284 | B2 | 10/2018 | Bacallao et al. | |
| 2002/0000504 | A1 | 1/2002 | Bayne | |
| 2003/0168378 | A1 | 9/2003 | Au | |
| 2004/0112850 | A1 | 6/2004 | Jordan | |
| 2005/0114216 | A1 * | 5/2005 | Lantz | A47F 9/045 705/16 |
| 2005/0258177 | A1 | 11/2005 | Woodson | |
| 2006/0021956 | A1 | 2/2006 | Wilfong | |
| 2007/0176058 | A1 | 8/2007 | Kohn et al. | |
| 2007/0181753 | A1 | 8/2007 | Herlands | |
| 2009/0206091 | A1 | 8/2009 | Hoffmann | |
| 2009/0289019 | A1 | 11/2009 | Alvarado et al. | |
| 2010/0012793 | A1 | 1/2010 | Sung | |
| 2010/0021088 | A1 | 1/2010 | Wilfong, Jr. | |
| 2010/0096514 | A1 | 4/2010 | Adair et al. | |
| 2010/0148019 | A1 | 6/2010 | Simhaee | |
| 2010/0314507 | A1 | 12/2010 | Laitila et al. | |
| 2011/0266092 | A1 | 11/2011 | Marquis et al. | |
| 2012/0118839 | A1 | 5/2012 | Tan | |
| 2013/0223766 | A1 | 8/2013 | Gebhardt | |
| 2013/0259405 | A1 | 10/2013 | Jack | |
| 2013/0284756 | A1 | 10/2013 | Springer et al. | |
| 2014/0138499 | A1 | 5/2014 | Laitila et al. | |
| 2015/0048039 | A1 | 2/2015 | Laitila et al. | |
| 2017/0020307 | A1 | 1/2017 | Davis, Jr. | |
| 2017/0055727 | A1 | 3/2017 | Tan | |
| 2017/0217621 | A1 * | 8/2017 | Robinson | B65B 67/1233 |
| 2017/0280900 | A1 | 10/2017 | Bacallao | |
| 2017/0325603 | A1 | 11/2017 | Bacallao | |
| 2017/0354274 | A1 * | 12/2017 | Bacallao | A47F 9/042 |
| 2018/0049565 | A1 * | 2/2018 | Bacallao | F24F 11/30 |
| 2018/0064266 | A1 * | 3/2018 | Bacallao | A47F 5/01 |
| 2018/0065770 | A1 * | 3/2018 | Bacallao | A47F 5/01 |
| 2018/0170597 | A1 * | 6/2018 | Bacallao | A45F 5/1046 |
| 2019/0127103 | A1 * | 5/2019 | Bacallao | B65B 67/1233 |
| 2019/0231096 | A1 | 8/2019 | Bacallao et al. | |
| 2019/0357705 | A1 | 11/2019 | Bacallao et al. | |

OTHER PUBLICATIONS

Web page image 1, accessed Dec. 29, 2015, https://www.google.co.in/imgres?imgurl=https://c1.staticflickr.com/3/2932/14248018844_89e3d89fa4_b.jpg&imgrefurl=https://www.flickr.com/photos/ieepersmedia/14248018844&h=950&w=1024&tbnid=MyLI_TOn6HIMCM:&docid=9feoV3Exk3O-4M&ei=jfyAVsbyJMPluASeoa6QBw&tbm=isch&ved=0ahUKEwiG7Z7tmv7JAhVDJI4KHZ6QC3IQMwgkKAkwCQ.

Web page image 2, accessed Dec. 29, 2015, https://www.flickr.com/photos/fourstarcashiemathan/6979145827.

"Over Door Bag Holder Waste Bin, Hang Over Kitchen Door, Reuses Shopping Bags," Klife, Ebay.com, accessed on May 23, 2016; 4 pages.

"100mm metal wire clip/clipboard clip," Dongguan Taoyuan Stationary Co., Ltd., Sell.Lulusoso.com, accessed May 20, 2016; 4 pages.

Notice of Allowance in U.S. Appl. No. 15/415,026 dated May 21, 2018; 6 pages.

Non-Final Office Action in U.S. Appl. No. 15/415,026, dated Dec. 28, 2017; 8 pages.

Non-Final Office Action in U.S. Appl. No. 15/695,401, dated Feb. 2, 2018; 7 pages.

(56) References Cited

OTHER PUBLICATIONS

Non-Final Office Action for U.S. Appl. No. 15/695,306, dated Apr. 18, 2018; 11 pages.
Notice of Allowance for U.S. Appl. No. 15/695,401, dated May 4, 2018; 8 pages.
Notice of Allowance for U.S. Appl. No. 15/695,306, dated Jul. 23, 2018; 7 pages.
Non-Final Office Action in U.S. Appl. No. 16/390,277 dated Sep. 24, 2019; 14 pages.
Notice of Allowance in U.S. Appl. No. 16/390,277, dated Jan. 15, 2020; 5 pages.
Notice of Allowance in U.S. Appl. No. 16/390,295, dated Jan. 15, 2020; 11 pages.

* cited by examiner

BAG RETAINING FIXTURE

CROSS REFERENCE TO RELATED APPLICATION

This invention claims priority to U.S. provisional patent application Ser. No. 62/577,433, filed Oct. 26, 2017, and entitled "Bag Retaining Fixture", which is incorporated entirely herein by reference.

BACKGROUND OF THE INVENTION

Technical Field

This invention relates to fixtures for retail stores, and more specifically to a fixture for holding a paper-type bag open at a bagging station while the bag is being filled.

State of the Art

A bagging station is a fixture in a retail store where purchased items are loaded into bags so the items can be carried out of the store by the customer. Bagging stations are often located at checkout registers where purchased items are paid for. Bagging stations are usually designed to store and dispense plastic bags. Bagging stations that dispense plastic bags will have hooks for hanging the plastic bags from. When paper-type bags are being dispensed at a bagging station instead of plastic bags, it is often difficult to keep the open bag in one place while it is being filled. The hooks used for plastic bags are usually not useful for paper-type bags. The open bag is often placed on the bagging station top surface, but it often slides and moves around unless something is used to hold the bag in place.

Accordingly, what is needed is a bag retaining fixture that can temporarily hold an open paper-type bag in place at a bagging station, keeping the open bag from moving around while it is being filled at the bagging station.

DETAILED DESCRIPTION OF EMBODIMENTS OF THE INVENTION

Figure 1:
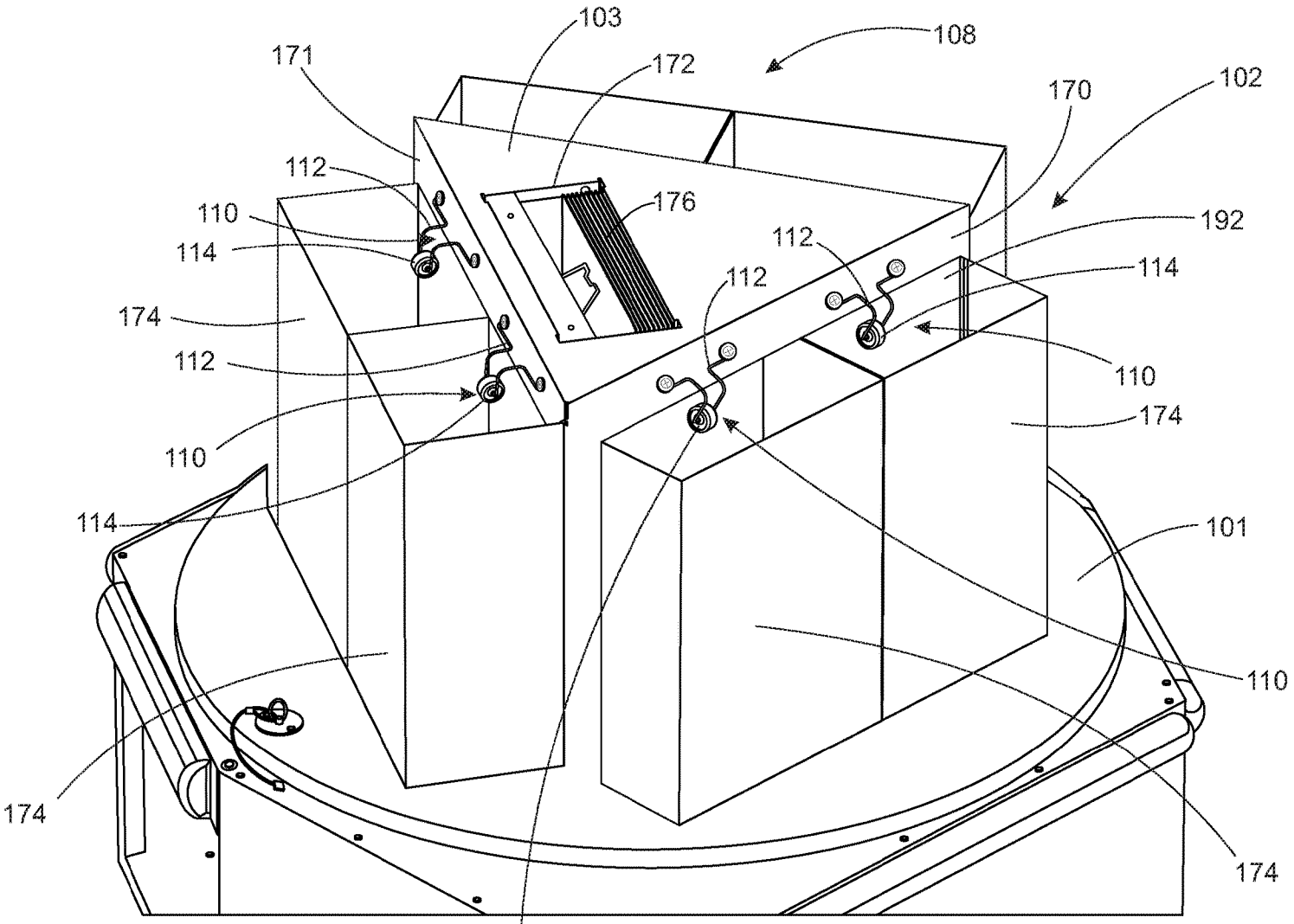
FIG. 1 shows a perspective view of a bagging station using a bag retaining fixture to hold paper-type bags.

The disclosed invention relates to fixtures for a retail store, and more specifically to a fixture for holding a paper-type bag in place while the bag is being filled at a bagging station.

A bagging station is a location in a retail store where purchased items are loaded into bags so the items can be carried out of the store by the customer. Bagging stations are often at checkout registers where purchased items are paid for. Bagging stations are usually designed to store and dispense plastic bags. The bagging station for plastic bags will often will have hooks and arms for holding stacks of plastic bags, and for hanging plastic bag arms from, to keep the plastic bag open while filling. In some locations and jurisdictions, however, paper-type bags are used instead of plastic bags. A paper-type bag is a bag made of semi-rigid material. Paper-type bags includes traditional brown paper bags, as well as bags made of semi-rigid plastic or composite materials. Paper-type bags often do not hang from their arms, but instead are rigid enough to sit, when open, on their bottom on a flat surface. The term "paper bag" is used throughout this document, but it is to be understood that bags formed of other semi-rigid material such as plastic or composite materials can be substituted for the paper bags described in this document. Some customers and locations prefer paper bags over plastic. Some jurisdictions have ruled that paper bags should be used instead of plastic bags. Environmental laws or restrictions can often dictate that paper bags be used in retail stores instead of plastic bags.

In order to make bagging stations work well with paper bags, it is desirable to have a bag retaining fixture that will hold an open paper bag on the bagging station while the bag is being filled. Described herein is a bagging station that uses a bag retaining fixture. The bag retaining fixture holds open paper bags at the bagging station so the paper bags can be filled without the bag moving or falling off the bagging station. The bag retaining fixture includes an elongate rod and a roller wheel that slides onto the elongate rod and rotates on the elongate rod. The bag retaining fixture is coupled to the bagging station. The elongate rod, with the roller wheel slid onto the elongate rod, is coupled to a side of the bagging station such that the elongate rod with roller wheel captures a side of a paper bag between the roller wheel and the side wall of the bagging station. The bagging station can have a number of bag retaining fixtures coupled to it, so that a number of bags can be held open at a time and filled with purchased items. The described bag retaining fixture can be used with any bag with a side that can be held between the bag retaining fixture and a wall of the bagging station. The bag retaining fixtures keep paper bags in place at the bagging station, allow bagging station carousels to rotate without throwing off the open paper bags, and keeps bagging stations neat and useful with paper bags as well as plastic bags.

Figure 2:
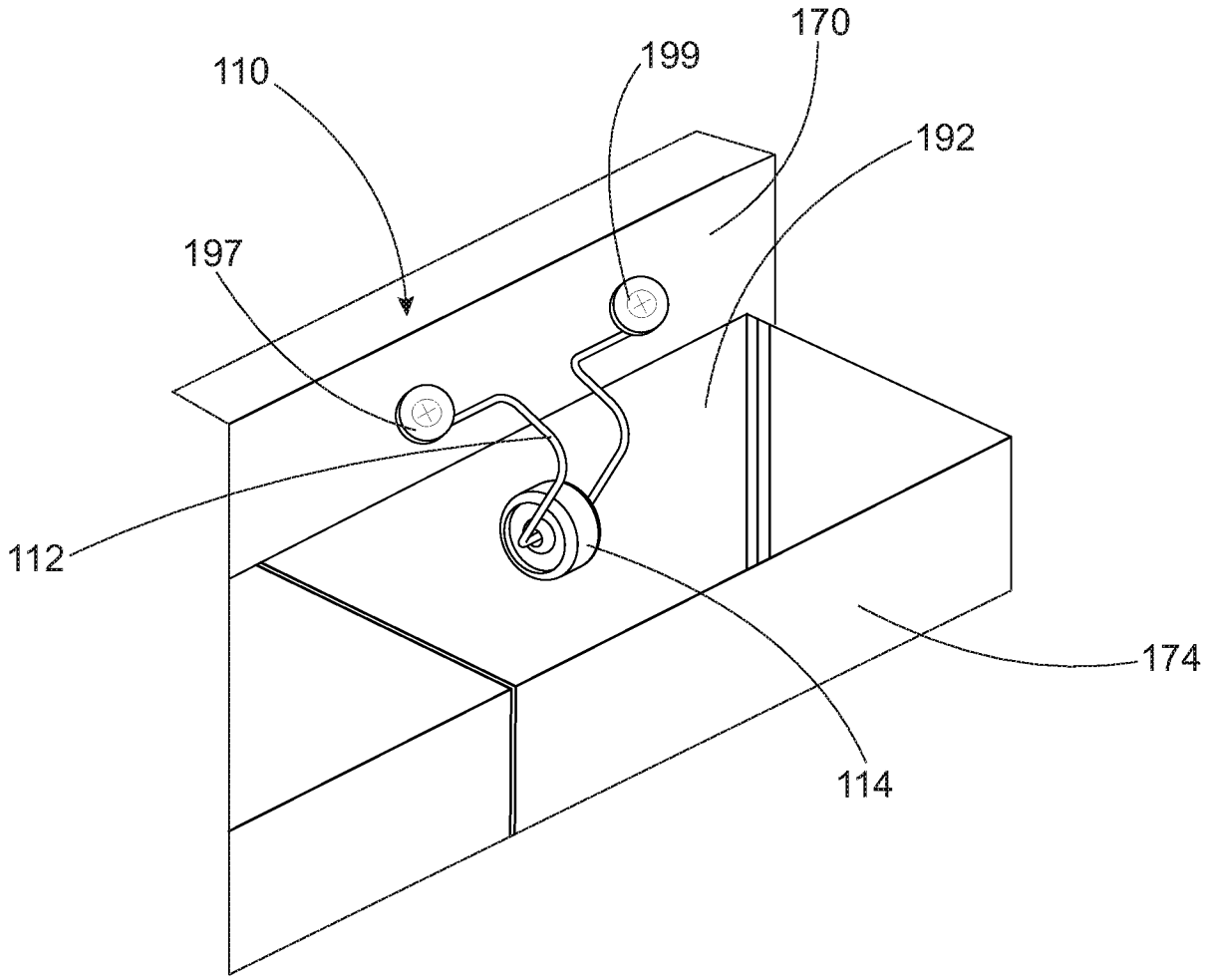
FIG. 2 shows a close-up perspective view of a bag retaining fixture holding a paper-type bag on the bagging station of FIG. 1.
Figure 3:
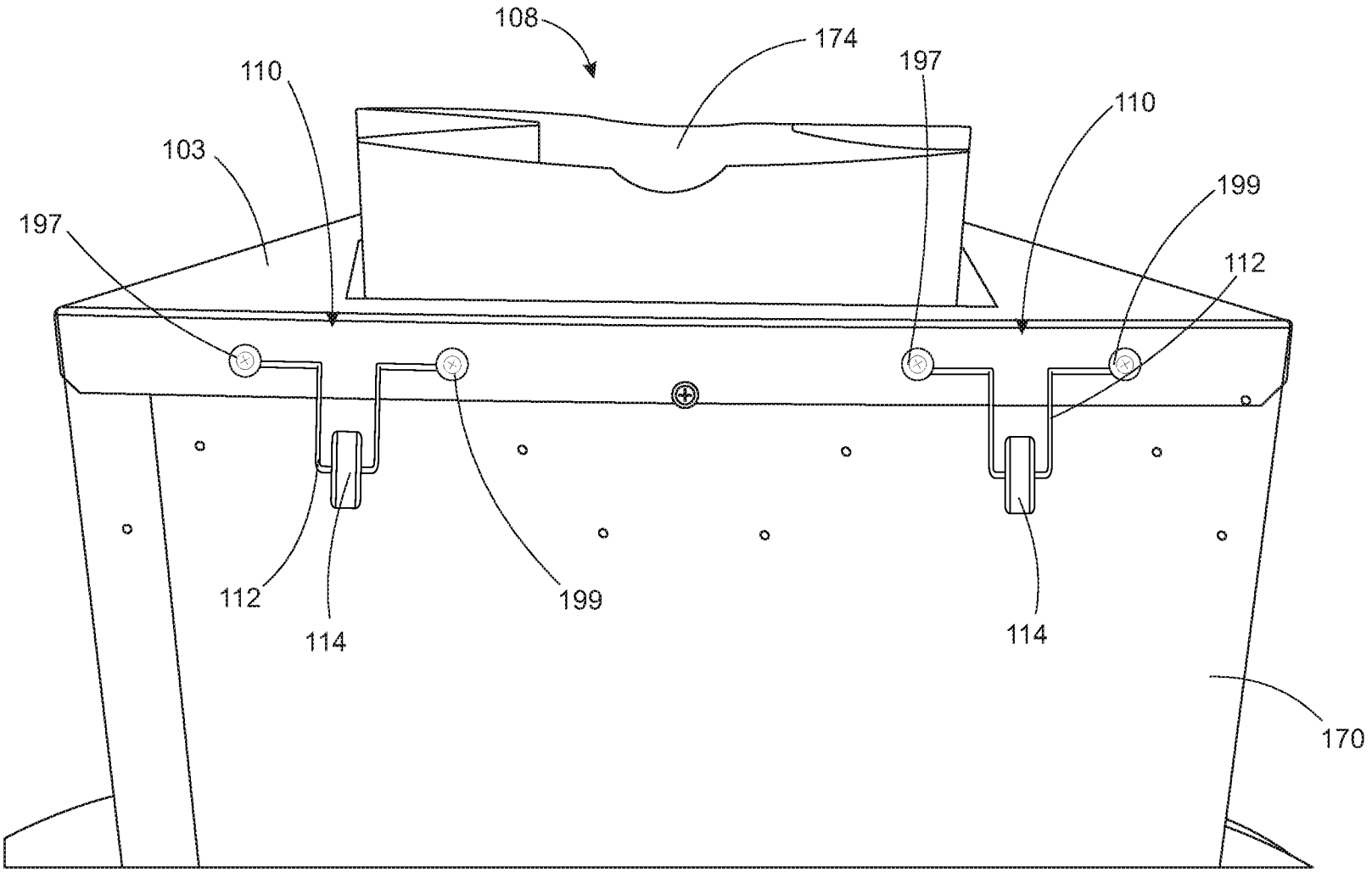
FIG. 3 shows a side wall of the bagging station of FIG. 1 with two bag retaining fixtures coupled to the side wall.
Figure 4:
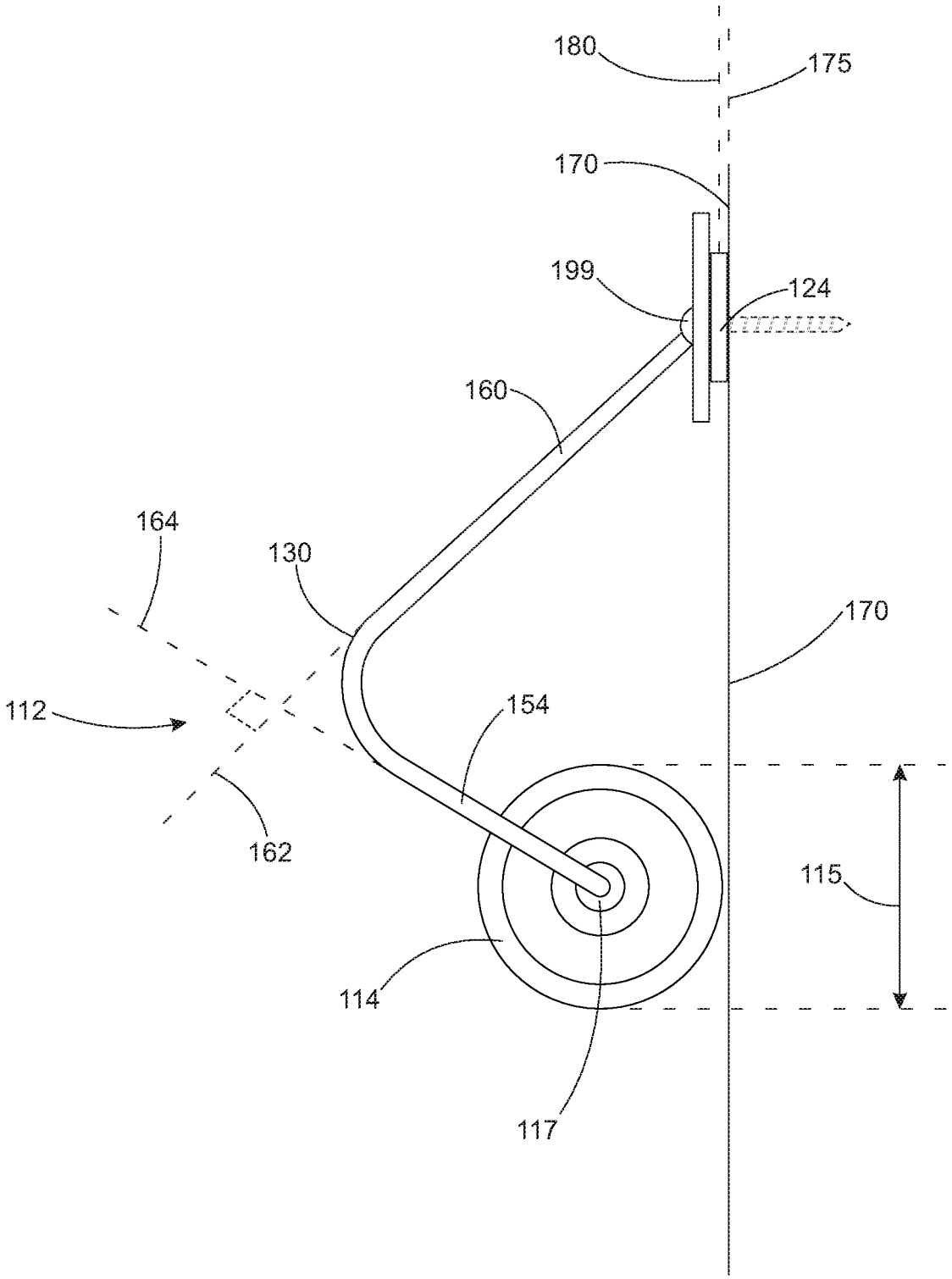
FIG. 4 shows a side view of a bag retaining fixture coupled to a side wall of the bagging station of FIG. 1.

FIG. 1 through FIG. 4 shows a bagging station 108 for use in a retail store for filling paper-type bags. FIG. 1 shows bagging station 108 with a plurality of bag retaining fixtures 110 for holding paper bags 174. FIG. 2 shows an enlarged view of bag retaining fixture 110 holding an open paper bag 174 at bagging station 108 of FIG. 1. FIG. 3 shows a side wall 170 of bagging station 108 with two bag retaining fixtures 110 coupled to side wall 170. FIG. 4 shows a side view of bag retaining fixture 110 coupled to side wall 170 of bagging station 108 of FIG. 1. Bag retaining fixture 110 holds bags 174 open at bagging station 108 so that each bag 174 can be filled with purchased items and does not fall off of bagging station 108.

Bagging station 108 is a carousel-type bagging station that is often used at a checkout register of a retail store for bagging items that have been purchased in the retail store. Bagging station 108 includes a bagging station carousel 102 that includes a rotating platform 101 and a center section 103 with three side walls, including side wall 170 and side wall 171. Bagging station 108 also includes at least one bag 174 positioned on carousel 102. Center section 103 has a cabinet 172 for holding a stack of paper bags 176, in this embodiment. Bagging station 108 includes at least one bag retaining fixture 110 coupled to one of the side walls 170 or 171. Center section 103, in this embodiment, has a number of bag retaining fixtures 110 on its side walls 170 and 171, as shown in FIG. 1. Bag retaining fixtures 110 hold paper bags 174 from moving around or falling off of bagging station 108, as shown. Each bag retaining fixture 110 holds a side 192 of a bag 174 between a roller wheel 114 and side wall 170 or 171 of center section 103, as best seen in FIG. 2. Rotating platform 101 rotates to allow a bagger to place items in paper bags 174 as they are purchased. Paper bags 174 that are full can be removed from bagging station 108 and carried out of the retail store. Once a bag 174 is removed, an empty paper bag 174 can be retrieved from stack of paper bags 176, opened, and put in place on carousel 102 for filling, held in place with bag retaining fixture 110. FIG. 1 through FIG. 4 show bag retaining fixture 110 being used to hold the side of paper bags 174 on bagging station 108, but it is to be understood that bag retaining fixture 110 can be used with any type of bag on any type of bagging station. Bagging fixture 110 can be used to hold the side of any type of bag against a surface.

Figure 5:
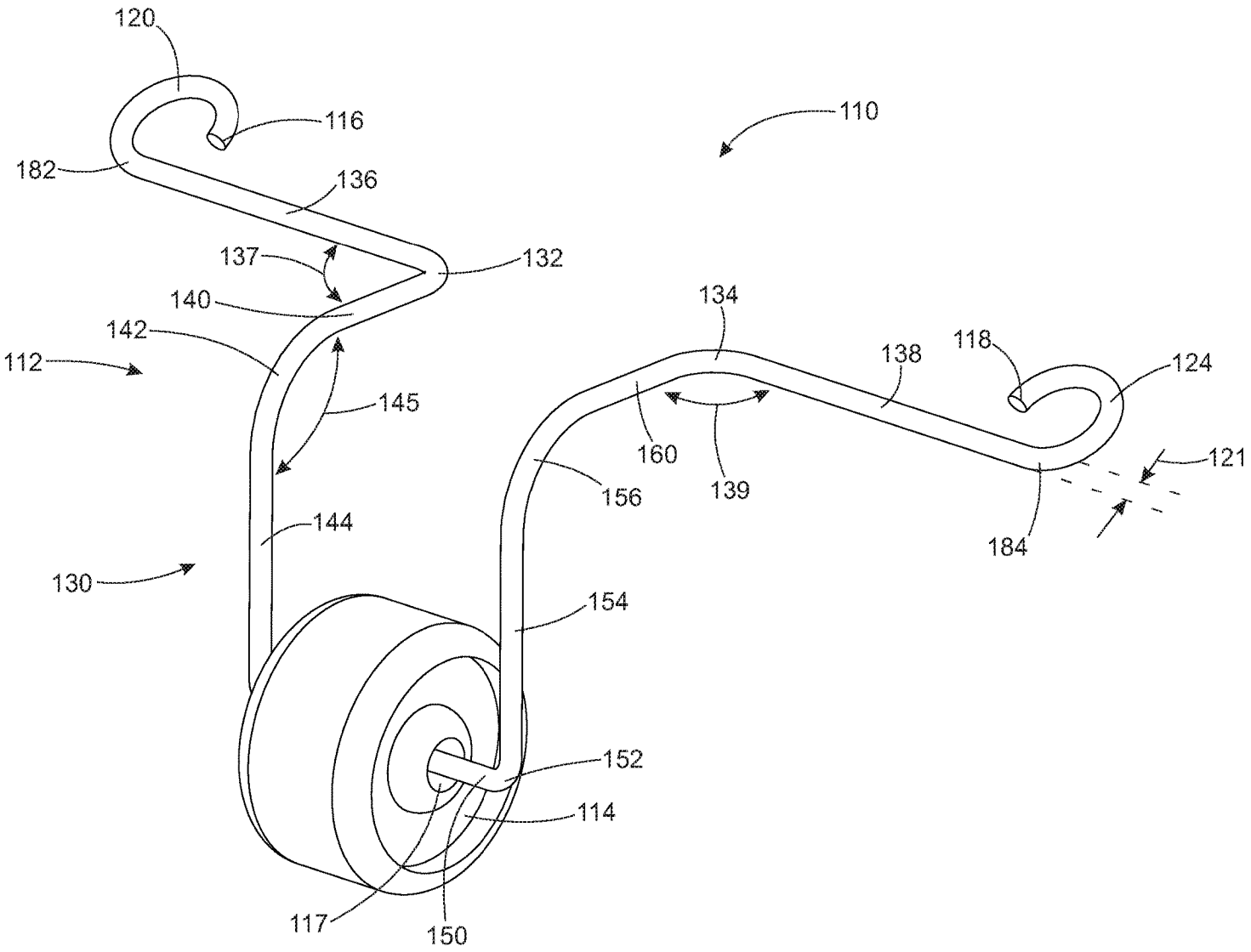
FIG. 5 shows a perspective view of a bag retaining fixture.
Figure 6:
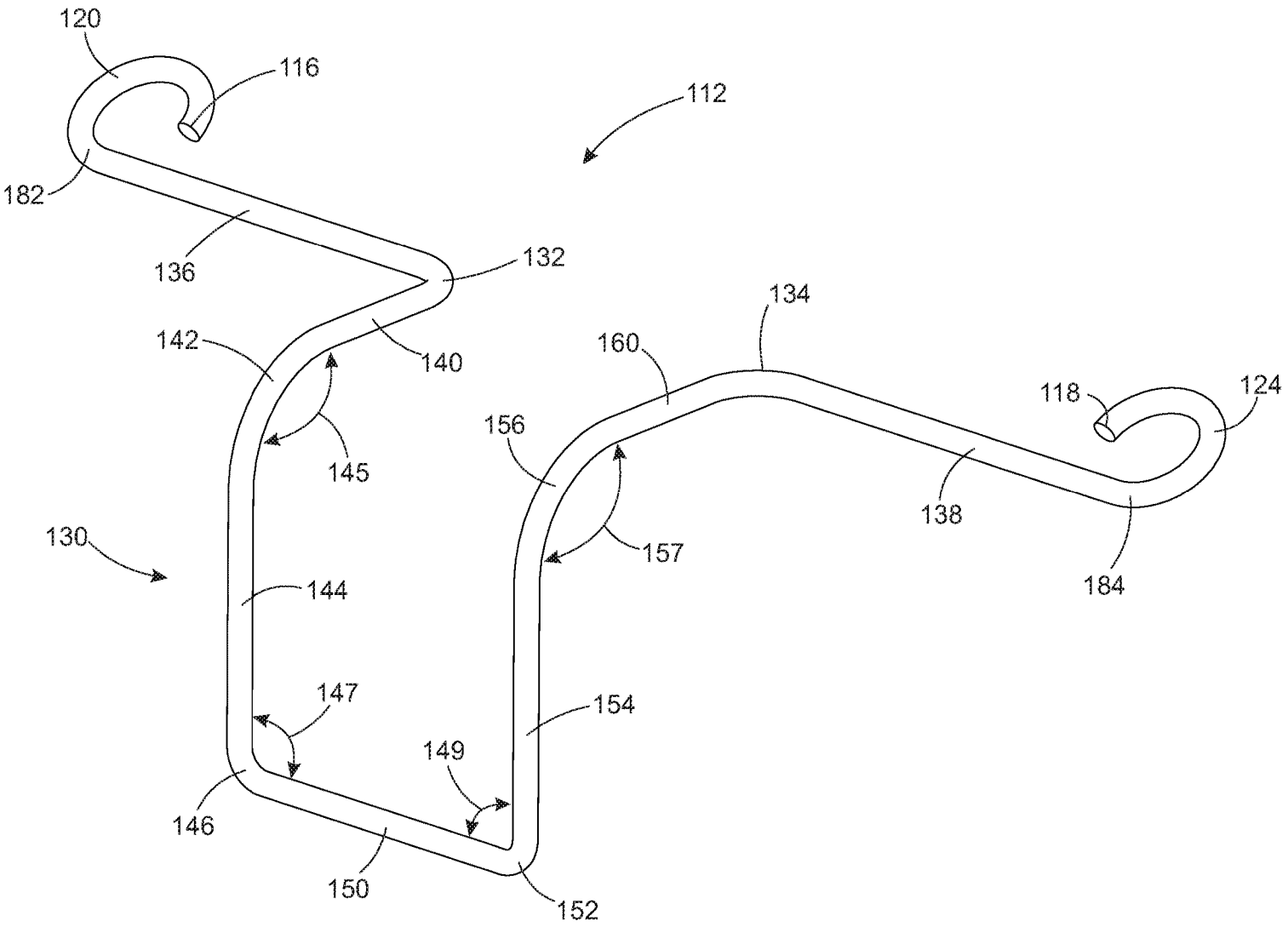
FIG. 6 shows a perspective view of an elongate rod of the bag retaining fixture of FIG. 5.
Figure 7:
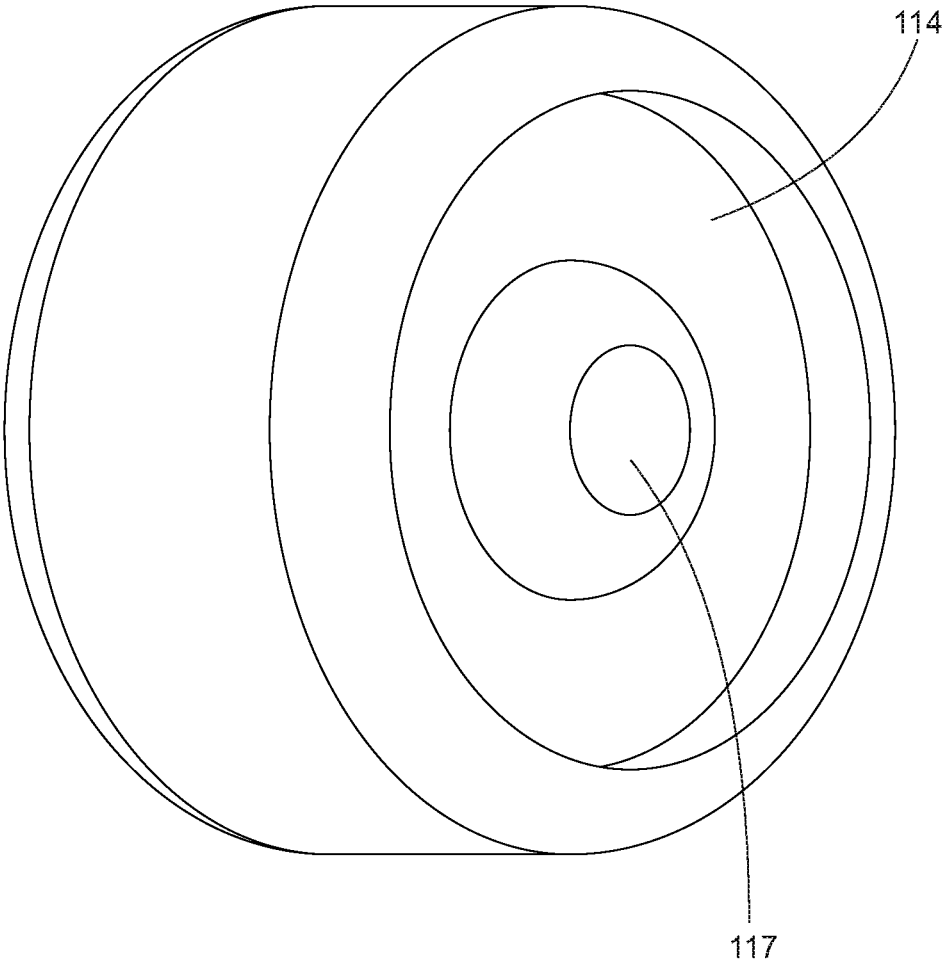
FIG. 7 shows a perspective view of a roller wheel of the bag retaining fixture of FIG. 5.

FIG. 5 through FIG. 7 shows details of bag retaining fixture 110. FIG. 5 shows a perspective view of bag retaining fixture 110. Bag retaining fixture 110 includes an elongate rod 112 and a roller wheel 114. FIG. 6 shows a perspective view of elongate rod 112 of bag retaining fixture 110. FIG. 7 shows a perspective view of roller wheel 114 of bag retaining fixture 110.

Each bag retaining fixture 110 is coupled to a side wall 170 or 171 of bagging station 108, as shown in FIG. 1 through FIG. 4. Each bag retaining fixture 110 holds a bag 174 on bagging station 108 by pressing roller wheel 114 against side wall 170 or 171 and pressing a side 192 of bag 174 between roller wheel 114 and side wall 170 or 171, as best seen in FIG. 2. The pressure of roller wheel 114 on side 192 of paper bag 174 keeps bag 174 in place on bagging station 108 as purchased items are placed in bag 174. Roller wheel 114 is coupled to and rotates on elongate rod 112. The rotation of roller wheel 114 on elongate rod 112 makes it easy to slip side 192 of paper bag 174 in between roller wheel 114 and side wall 170 or 171 to fill paper bag 174, and then to remove side 192 of paper bag 174 from between roller wheel 114 and side wall 170 or 171, once paper bag 174 is full. Elongate rod 112 biases roller wheel 114 against side wall 170 or 171 of bagging station 108 to hold side 192 of bag 174 between roller wheel 114 and side wall 170 or 171.

Bag retaining fixture 110 includes elongate rod 112 and roller wheel 114, as shown in the figures. Roller wheel 114 is coupled to elongate rod 112. Roller wheel 114 is a slidable roller wheel 114 because roller wheel 114 slides onto elongate rod 112 to couple roller wheel 114 to elongate rod 112. Also, roller wheel 114 slidingly rotates on elongate rod 112 once roller wheel 114 is slid onto elongate rod 112. Roller wheel 114 sliding onto elongate rod 112 means that elongate rod 112 extends through an axle hole 117 in roller wheel 114 (see FIG. 4, FIG. 5, and FIG. 7). With roller wheel 114 coupled to elongate rod 112, elongate rod 112 acts as an axle for roller wheel 114, and roller wheel 114 rotates on elongate rod 112.

Roller wheel 114 has a roller wheel diameter 115 (FIG. 4) that is large compared to an elongate rod diameter 121 (FIG. 5) of elongate rod 112. In the embodiment shown in the figures, roller wheel diameter 115 is 10 times larger than elongate rod diameter 121. In some embodiments, roller wheel diameter 115 is 5 times larger than elongate rod diameter 121. In some embodiments, roller wheel diameter 115 is 20 times the size of elongate rod diameter 121. In some embodiments, roller wheel diameter 115 is 5-20 times larger than elongate rod diameter 121. Having roller wheel diameter being 5-20 times larger than elongate rod diameter 121 makes it easier to rotate roller wheel 114 on elongate rod 112 than if roller wheel diameter 115 was less than 5 times the size of elongate rod diameter 121. When roller wheel diameter 115 is less than 5 times the size of elongate rod diameter 121, roller wheel 114 does not rotate as easily, making it more difficult to insert and remove side 192 of paper bag 174 from between roller wheel 114 and side wall 170 or 171 of bagging station 108. When roller wheel diameter 115 is more than 20 times larger than elongate rod diameter 121, roller wheel 114 can become too large and bulky and impede the loading of items into bag 174.

Elongate rod 112 has an elongate rod first end 116 and an elongate rod second end 118. Elongate rod first end 116 and elongate rod second end 118 are both coupled to a side wall 170 or 171 of bagging station 108, as shown in FIG. 1 through FIG. 4.

Elongate rod 112 is divided into several sections, with bends between the sections that help shape elongate rod 112 to hold bags 174 on bagging station 108. Elongate rod 112 has a first end portion 120 and a second end portion 124, see FIG. 5 and FIG. 6. Each of first end portion 120 and second end portion 124 are circular shaped. First end portion 120 and second end portion 124 are each lengths of elongate rod 112 at either end of elongate rod 112. First end portion 120 and second end portion 124 are each bent or otherwise formed into a circular shape, as shown in the figures, so that a first coupler 197 can be extended through first end portion 120 to couple first end portion 120 and elongate rod 112 to side wall 170 (or side wall 171), and a second coupler 199 can be extended through second end portion 124 to couple second end portion 124 to side wall 170 (or side wall 171) as shown in FIG. 1 through FIG. 4. First and second couplers 197 and 199 are screws and washers in this embodiment, but this is not meant to be limiting. First and second couplers 197 and 199 can be any coupler (screw, bolt, nail, etc) that couples first and second end portions 120 and 124 to side wall 170 or 171.

First end portion 120 extends from elongate rod first end 116 to a first leg portion end 182, as shown in FIG. 5 and FIG. 6. First end portion 120 is bent or formed into a circular shape so that first coupler 197 can be extended through first end portion 120 to couple elongate rod first end 116, first end portion 120, and bag retaining fixture 110 to side wall 170, as best seen in FIG. 2. A washer of coupler 197, in this embodiment, has a diameter larger than the diameter of the circular shape of first end portion 120. Coupling coupler 197 to side wall 170 presses first end portion 120 against side wall 170 and couples first end portion 120 and bag retaining fixture 110 to side wall 170.

Second end portion 124 extends from elongate rod second end 118 to a second leg portion end 184, as shown in FIG. 5 and FIG. 6. Second end portion 124 is bent or formed into a circular shape so that second coupler 199 can be extended through second end portion 124 to couple elongate rod second end 118, second end portion 124, and bag retaining fixture 110 to side wall 170, as best seen in FIG. 2 and FIG. 4. A washer of coupler 199 has a diameter larger than the diameter of the circular shape of second end portion 124. Coupling coupler 199 to side wall 170 presses second end portion 124 against side wall 170 and couples second end portion 124 and bag retaining fixture 110 to side wall 170. Once first and second end portions 120 and 124 are coupled to side wall 170 with couplers 197 and 199, first leg portion 120 and second leg portion 124 are each parallel to side wall 170 (or 171). For example, side wall 170 lies in a plane 175, as shown in FIG. 4. First and second end portions 120 and 124 lie in a plane 180, as shown in FIG. 4. Plane 175 is parallel to plane 180 in this embodiment, meaning first and second end portions 120 and 124 are parallel to side wall 170.

Elongate rod 112 also has a first leg portion 136, a second leg portion 138, and a bag retaining section 130, see FIG. 5 and FIG. 6. First leg portion 136, second leg portion 138, and bag retaining section 130 are each lengths of elongate rod 112 that are bent or otherwise formed into a shape to hold a paper bag on bagging station 108. Bag retaining section 130 holds roller wheel 114 and biases slidable roller wheel 114 against side wall 170 or 171 to hold side 192 of bag 174 between roller wheel 114 and side wall 170 or 171. First leg portion 136 couples bag retaining section 130 to first end portion 120. Second leg portion 138 couples bag retaining section 130 to second end portion 124.

First leg portion 136 extends from first leg portion end 182 to a bag retaining section first end 132, see FIG. 5 and FIG. 6. First leg portion 136 is straight, and couples bag retaining section 130 to first end portion 120. Second leg portion 138 extends from second leg portion end 184 to a bag retaining section second end 134, see FIG. 5 and FIG. 6. Second leg portion 138 is straight, and couples bag retaining section 130 to second end portion 124. First leg portion 136 and second leg portion 138 are colinear, in this embodiment.

Bag retaining section 130 extends from bag retaining section first end 132 to bag retaining section second end 134, see FIG. 5 and FIG. 6. Bag retaining section 130 extends through and holds roller wheel 114. Once bag retaining fixture 110 is coupled to side wall 170, bag retaining section 130 biases roller wheel 114 against side wall 170 so that slidable roller wheel 114 holds side 192 of bag 174 against side wall 170. This holds bag 174 open and keeps bag 174 in place on bagging station 108 so that bag 174 can be filled with items.

Bag retaining section 130 is divided into several different lengths of elongate rod 112. Bag retaining section 130 includes a first extension arm 140, a second extension arm 160, a first roller arm 144 and a second roller arm 154, and a roller axle 150. Roller wheel 114 is coupled to, and rotates around, roller axle 150, as shown in FIG. 5.

First extension arm 140 is coupled to first leg portion 136. First extension arm 140 extends from bag retaining section first end 132 to a first roller arm first end 142. First extension arm 140 forms a first leg angle 137 (FIG. 5) between first extension arm 140 and first leg portion 136. In this embodiment, first extension arm 140 is perpendicular to first leg portion 136, meaning first leg angle 137 is a 90 degree angle. In some embodiments, first leg angle 137 is between 50 and 130 degrees.

Second extension arm 160 is coupled to second leg portion 138. Second extension arm 160 extends from bag retaining section second end 134 to a second roller arm first end 156. Second extension arm 160 is coupled to second roller arm first end 156 off a second roller arm 154. Second extension arm 160 forms a second leg angle 139 (FIG. 5) between second extension arm 160 and second leg portion 138. In this embodiment, second extension arm 160 is perpendicular to second leg portion 138, meaning second leg angle 139 is a 90 degree angle. In some embodiments, second leg angle 139 is between 50 and 130 degrees.

First roller arm 144 is coupled to first extension arm 140. First roller arm 144 extends from first roller arm first end 142 to first roller arm second end 146 (FIG. 6). First roller arm 144 forms a first roller arm angle 145 between first roller arm 144 and first extension arm 140. In this embodiment, first roller arm 144 is perpendicular to first extension arm 140, meaning first roller arm angle 145 is a 90 degree angle. In some embodiments, first roller arm angle 145 is between about 45 and 135 degrees.

Second roller arm 154 is coupled to second extension arm 160. Second roller arm 154 extends from second roller arm first end 156 to second roller arm second end 152. Second roller arm 154 forms a second roller arm angle 157 (FIG. 6) between second roller arm 154 and second extension arm 160. In this embodiment, second roller arm 154 is perpendicular to second extension arm 160, meaning second roller arm angle 157 is a 90 degree angle. In some embodiments, second roller arm angle 157 is between about 45 and 135 degrees.

Roller axle 150 is a straight section of elongate rod 112 that extends from first roller arm second end 146 to second roller arm second end 152. Roller wheel 114 is coupled to roller axle 150. Roller axle 150 extends through axle hole 117 in roller wheel 114 such that roller axle 150 acts as an axle to roller wheel 114. Roller wheel 114 rotates about roller axle 150. Roller axle 150 forms a first roller axle angle 147 between roller axle 150 and first roller arm 144. In this embodiment, roller axle 150 is perpendicular to first roller arm 144, and so first roller axle angle 147 is a 90 degree angle. In some embodiments, first roller axle angle 147 is between 85 and 135 degrees. Roller axle 150 forms a second roller axle angle 149 between roller axle 150 and second roller arm 154. In this embodiment, roller axle 150 is perpendicular to second roller arm 154, and so second roller axle angle 149 is a 90 degree angle. In some embodiments, second roller axle angle 149 is between 85 and 135 degrees. Roller axle 150, in this embodiment, is parallel to first leg portion 136 and second leg portion 138, but this is not meant to be limiting.

In the embodiment of bag retaining fixture 110 shown in the figures, first leg portion 136, first extension arm 140, second extension arm 160, and second leg portion 138 each lie in a first plane 162, as shown in FIG. 4. First roller arm 144, second roller arm 154, and roller axle 150 each lie in a second plane 164 that is different from first plane 162, as shown in FIG. 4. In this embodiment, first plane 162 is perpendicular to second plane 164, but this is not meant to be limiting.

FIG. 7 shows a perspective view of roller wheel 114. Roller wheel 114 rolls on roller axle 150. Bag retaining section 130 of bag retaining fixture 110 presses roller wheel 150 against side wall 170 (FIG. 2 and FIG. 4). When a side 192 of paper bag 174 is slid between roller wheel 114 and side wall 170, roller wheel 114 puts pressure on side 192 to hold bag 174 and keep bag 174 open and from falling off of bagging station 108. Allowing roller wheel 114 to rotate on roller axle 150 makes it easier to slide side 192 of paper bag 174 in between roller wheel 114 and side wall 170 and out from between roller wheel 114 and side wall 170, making it easy to have bag retaining fixture 110 hold bag 174 at bagging station 108.

A bagging station has been shown and described that holds bags for filling with purchased products. The bagging station holds paper bags instead of the traditional plastic bags used by many retail stores. The bagging station holds paper bags because the bagging station includes a bag retaining fixture that can hold paper bags instead of hooks for holding plastic bags. The bag retaining fixture includes an elongate rod and a roller wheel. The roller wheel is coupled to the elongate rod and rotates on the elongate rod. The elongate rod acts as an axle for the roller wheel. The elongate rod is bent or otherwise formed into several different portions that help to hold paper bags at the bagging station. The elongate rod is coupled to a side wall of the bagging station. The elongate rod biases the roller wheel against the side wall. A side of a paper bag placed between the roller wheel and the side wall holds the paper bag in position on the bagging station so the bag can be filled with purchased items, then removed to be carried out of the store.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bagging station comprising:

a bagging station carousel having at least one side wall;

a bag retaining fixture coupled to the at least one side wall, wherein the bag retaining fixture comprises:

an elongate rod having an elongate rod first end and an elongate rod second end opposing the elongate rod first end, wherein the elongate rod first end and the elongate rod second end are coupled to the at least one side wall; and a roller wheel coupled to the elongate rod, wherein the roller wheel rotates on the elongate rod, and wherein a roller wheel diameter is at least 5 times larger than an elongate rod diameter; and at least one bag position on the carousel;

wherein the elongate rod biases the roller wheel against the at least one side wall to hold a side of the at least one bag between the roller wheel and the at least one side wall.

2. The bagging station of claim 1, wherein the elongate rod further comprises:

a circular first end portion, wherein the circular first end portion extends from the elongate rod first end to a first leg portion end, wherein a first coupler extends through the circular first end portion to couple the circular first end portion to the at least one side wall;

a first leg portion extending from the first leg portion end to a bag retaining section first end, wherein the first leg portion is straight;

a bag retaining section comprising the bag retaining section first end and a bag retaining section second end opposing the bag retaining section first end, wherein the bag retaining section first end is coupled to the first leg portion, and wherein the bag retaining section biases the roller wheel against the at least one side wall to hold the side of the at least one bag between the roller wheel and the at least one side wall;

a second leg portion extending from the bag retaining section second end to a second leg portion end, wherein the second leg portion is straight;

and a circular second end portion, wherein the circular second end portion extends from the second leg portion end to the elongate rod second end, and wherein a second coupler extends through the circular second end portion to couple the circular second end portion to the at least one sidewall.

3. The bagging station of claim 2, wherein the first leg portion and the second leg portion are parallel to the at least one side wall.

4. The bagging station of claim 2, wherein the bag retaining section further comprises:

a first extension arm coupled to the first leg portion, wherein the first extension arm extends from the bag retaining section first end to a first roller arm first end, and wherein the first extension arm is perpendicular to the first leg portion;

a first roller arm coupled to the first extension arm, wherein the first roller arm extends from the first roller arm first end to a first roller arm second end, and wherein the first roller arm is perpendicular to the first extension arm;

a roller axle coupled to the first roller arm, wherein the roller axle extends from the first roller arm second end to a second roller arm second end, and wherein the roller axle is straight, and wherein the roller axle is perpendicular to the first roller arm;

a second roller arm coupled to the roller axle, wherein the second roller arm extends from the second roller arm second end to a second roller arm first end; and a second extension arm coupled to the second roller arm first end, wherein the second extension arm extends from the second roller arm first end to the bag retaining section second end.

5. The bagging station of claim 4, wherein the roller axle extends through an axle hole in the roller wheel.

6. The bagging station of claim 5, wherein the first leg portion, the first extension arm, the second extension arm, and the second leg portion lie in a first plane.

7. The bagging station of claim 6, wherein the first roller arm, the second roller arm, and the roller axle lie in a second plane different from the first plane.

8. The bagging station of claim 7, wherein the first plane is perpendicular to the second plane.

9. The bagging station of claim 4, wherein the second roller arm is perpendicular to the roller axle.

10. The bagging station of claim 9, wherein the second extension arm is perpendicular to the second roller arm.

11. A bag retaining fixture comprising:

an elongate rod comprising:

an elongate rod first end and an elongate rod second end opposing the elongate rod first end;

a circular first end portion, wherein the circular first end portion extends from the elongate rod first end to a first leg portion end, and wherein the circular first end portion is configured to receive a first coupler;

a first leg portion extending from the first leg portion end to a bag retaining section first end, wherein the first leg portion is straight;

a bag retaining section, wherein the bag retaining section extends from the bag retaining section first end to a bag retaining section second end opposing the bag retaining section first end, wherein the bag retaining section first end is coupled to the first leg portion, and wherein the bag retaining section holds a roller wheel;

a second leg portion extending from the bag retaining section second end to a second leg portion end, wherein the second leg portion is straight;

and a circular second end portion, wherein the circular second end portion extends from the second leg portion end to the elongate rod second end, and wherein the circular second end portion is configured to receive a second coupler;

and wherein the roller wheel rotates on the elongate rod, and wherein a roller wheel diameter of the roller wheel is about 10 times larger than an elongate rod diameter.

12. The bag retaining fixture of claim 11, wherein the first leg portion and the second leg portion are colinear.

13. The bag retaining fixture of claim 11, wherein the bag retaining section comprises:

a first extension arm coupled to the first leg portion, wherein the first extension arm extends from the bag retaining section first end to a first roller arm first end, wherein the first extension arm is perpendicular to the first leg portion;

a first roller arm coupled to the first extension arm, wherein the first roller arm extends from the first roller arm first end to a first roller arm second end, and wherein the first roller arm is perpendicular to the first extension arm;

a roller axle coupled to the first roller arm, wherein the roller axle extends from the first roller arm second end to a second roller arm second end, and wherein the roller axle is straight, and wherein the roller axle is perpendicular to the first roller arm;

a second roller arm coupled to the roller axle, wherein the second roller arm extends from the second roller arm second end to a second roller arm first end; and a second extension arm coupled to the second roller arm first end, wherein the second extension arm extends from the second roller arm first end to the bag retaining section second end.

14. The bag retaining fixture of claim 13, wherein the roller axle extends through an axle hole in the roller wheel.

15. The bag retaining fixture of claim 13, wherein the first leg portion, the first extension arm, the second extension arm, and the second leg portion lie in a first plane.

16. The bag retaining fixture of claim 15, wherein the first roller arm, the second roller arm, and the roller axle lie in a second plane different from the first plane.

17. The bag retaining fixture of claim 16, wherein the first plane is perpendicular to the second plane.

18. The bag retaining fixture of claim 13, wherein the second roller arm is perpendicular to the roller axle.

19. The bag retaining fixture of claim 18, wherein the second extension arm is perpendicular to the second roller arm.

20. The bag retaining fixture of claim 19, wherein the second extension arm is perpendicular to the second leg portion.

* * * * *